US006430881B1

(12) United States Patent
Daudet et al.

(10) Patent No.: US 6,430,881 B1
(45) Date of Patent: Aug. 13, 2002

(54) TOP PLATE

(75) Inventors: Larry R. Daudet, Porter, IN (US); Edmund L. Ponko, Pittsburgh, PA (US); Gregory S. Ralph, Valparaiso, IN (US)

(73) Assignee: Aegis Metal Framing LLC, Chesterfield, MO (US)

( * ) Notice: Subject to any disclaimer, the term of this patent is extended or adjusted under 35 U.S.C. 154(b) by 0 days.

(21) Appl. No.: 09/573,916

(22) Filed: May 18, 2000

(51) Int. Cl.[7] ..... E04B 1/38

(52) U.S. Cl. ..... 52/92.2; 52/92.1; 52/696; 52/712; 52/715; 52/745.19

(58) Field of Search ..... 52/92.1, 92.2, 52/93.1, 93.2, 712, 715, 690, 696, 654.1, 745.19

(56) References Cited

U.S. PATENT DOCUMENTS

| | | | | |
|---|---|---|---|---|
| 947,514 A | | 1/1910 | Stevens | |
| 1,562,784 A | * | 11/1925 | Olsen | 52/715 X |
| 1,656,741 A | | 1/1928 | Lane | |
| 2,216,319 A | * | 10/1940 | McGee | 52/292 |
| 2,282,624 A | | 5/1942 | Upson et al. | |
| 2,686,959 A | | 8/1954 | Robinson | |
| 2,964,807 A | | 12/1960 | Kennedy | |
| 2,966,708 A | | 1/1961 | Freeman, Jr. | |
| 3,010,162 A | | 11/1961 | Klein | |
| 3,201,874 A | | 8/1965 | Christy | |
| 3,305,981 A | | 2/1967 | Biggs et al. | |
| 3,374,591 A | | 3/1968 | Tillisch et al. | |
| 3,465,488 A | | 9/1969 | Miller | |
| 3,668,828 A | | 6/1972 | Nicholas et al. | |
| 3,717,964 A | | 2/1973 | Brown et al. | |
| 3,845,601 A | | 11/1974 | Kostecky | |
| 3,886,688 A | | 6/1975 | Ragland | |
| 3,908,328 A | | 9/1975 | Nelsson | |

(List continued on next page.)

FOREIGN PATENT DOCUMENTS

| | | | | |
|---|---|---|---|---|
| AU | 253249 | * | 5/1963 | 52/712 |
| AU | 23961/77 | | 10/1978 | |
| CA | 2077170 | | 3/1994 | |
| EP | 0080088 | | 6/1983 | |
| EP | 0373727 | | 6/1990 | |
| EP | 0637656 | | 2/1995 | |
| GB | 1566160 | | 4/1980 | |
| GB | 2103264 A | | 2/1983 | |
| GB | 2272715 | | 5/1994 | |
| JP | 9-4067 | | 1/1997 | |

OTHER PUBLICATIONS

Metal Lite Inc. Brochure, Jul. 1991, Anaheim, California.

Delta Metal Products, Inc., Residential Steel Frame Construction Details, Jun. 1994, Views B.12, B.14, and B.18.

E.N. Lorre, Residential Steel Framing Construction Guide, 1993, Laguna Hills, CA, 17 C.3, C.2B, C.4, C.5, C.6, C.7, C.8, C.9, C.17, C.18, C.25, C.26, D.9, D.10, D.11, D.12, D.13A, D.13B, D. 14, D. 15, D.21A, D.20, D.21B, D. 22, D.23, E.11, E.12, E.13, E.14, E.15, E.16, E.19, F.1, F.2, F.3, F.4, F.5, F.6, F.7, F.8, F.14, F.15, F.16, F.19, F.20.

*Primary Examiner*—Laura A. Callo
(74) *Attorney, Agent, or Firm*—Kirkpatrick & Lockhart LLP

(57) ABSTRACT

An apparatus for attaching a building component to a structure. The apparatus may include a C-shaped support header that is sized to be received on a portion of a structure such as the top plate of a wall. A number of attachment tab assemblies are integrally formed in the support header and protrude therefrom to facilitate attachment of the building components to the support header.

26 Claims, 20 Drawing Sheets

U.S. PATENT DOCUMENTS

| | | | | | |
|---|---|---|---|---|---|
| 4,075,810 | A | | 2/1978 | Zakrzewski et al. | |
| 4,078,347 | A | | 3/1978 | Eastman et al. | |
| 4,080,771 | A | | 3/1978 | Weller | |
| 4,229,915 | A | | 10/1980 | Snow et al. | |
| 4,246,736 | A | | 1/1981 | Kovar et al. | |
| 4,490,956 | A | | 1/1985 | Palacio et al. | |
| 4,538,391 | A | | 9/1985 | Skrabis et al. | |
| 4,637,195 | A | | 1/1987 | Davis | |
| 4,669,235 | A | * | 6/1987 | Reinen | 52/92.2 X |
| 4,688,358 | A | | 8/1987 | Madray | |
| 4,704,829 | A | | 11/1987 | Baumker, Jr. | |
| 4,843,726 | A | | 7/1989 | Ward | |
| 4,932,173 | A | | 6/1990 | Commins | |
| 4,986,052 | A | | 1/1991 | Nelson | |
| 5,127,760 | A | | 7/1992 | Brady | |
| 5,161,345 | A | | 11/1992 | Sobjack, Sr. | |
| 5,274,973 | A | | 1/1994 | Liang | |
| 5,313,752 | A | | 5/1994 | Hatzinikolas | |
| 5,335,469 | A | | 8/1994 | Stuart | |
| 5,353,560 | A | | 10/1994 | Heydon | |
| 5,412,919 | A | | 5/1995 | Pellock et al. | |
| 5,497,591 | A | * | 3/1996 | Nelson | 52/93.1 X |
| D373,832 | S | | 9/1996 | Nomura | |
| 5,551,200 | A | | 9/1996 | Krug | |
| 5,596,860 | A | * | 1/1997 | Hacker | 52/92.1 X |
| 5,689,922 | A | | 11/1997 | Daudet | |
| 5,822,942 | A | | 10/1998 | Lucia, Jr. | |
| 5,870,874 | A | | 2/1999 | Brothers | |
| 6,006,487 | A | | 12/1999 | Leek | |

* cited by examiner

TOP PLATE

CROSS-REFERENCE TO RELATED APPLICATIONS

Not applicable.

FEDERALLY SPONSORED RESEARCH

Not applicable.

BACKGROUND OF THE INVENTION

1. Field of the Invention

The subject invention relates to devices for installing and supporting building components and, more particularly, to a spacer and support apparatus for supporting roof and floor trusses on the top plate of a wall or other structure.

2. Description of the Invention Background

A truss is a rigid framework of wooden, metal or plastic beams designed to support a structure, such as a roof. Trusses may also be employed to span between opposing support walls to create a floor supporting structure within a building. A truss system for supporting a floor may comprise a collection of trusses that are arranged adjacent to each other and span the distance between two or more support walls. Local building codes generally govern the amount of spacing permitted between each truss. When anchored to the support walls, the tops of the trusses are substantially co-planar with each other to enable floor decking materials to be attached thereto.

Roof trusses may be provided in a variety of different shapes and sizes depending upon the building design. Although some roof truss systems provide a plurality of planar, horizontally disposed, support surfaces for buildings with flat roof systems, many buildings have roofs that have planar portions that are not horizontally disposed. For example, many residential buildings have peaked roofs wherein the roof surface comprises a pair of angled planes that intersect to form the roof crown or peak. Flat sheathing material is attached to the trusses to form a planar roof surface and roofing material is then affixed to the sheathing. Trusses may be fabricated on site from appropriate material such as wood, metal, etc. However, it is common practice for trusses to be fabricated off-site by an entity that specializes in the fabrication of such building components. The prefabricated trusses are then shipped to the building site and anchored in place to the support structures. Such support structures may comprise concrete block walls, metal or wood stud walls, etc.

A truss typically includes a bottom member commonly referred to as the "bottom chord". The bottom chord is the member that is supported on and anchored to the top of the support walls. Trusses typically also include two or more top chords that are attached to the bottom chord. In a typical "peak roof" truss, two top chord members are each attached to one end of the bottom chord and angle upward at a desired pitch. The other ends of each top chord are connected together to form the roof peak. A portion of each top chord may extend beyond the bottom chord to form a desired amount of overhangs that extend beyond the support walls. Similarly, in other truss arrangements, the bottom chord may extend beyond the support walls in a cantilevered fashion. A variety of braces or web members extend between the top chords and the bottom chord to provide the roof with a desired load capacity.

Trusses are commonly installed by standing the bottom chords of the trusses on edge on the support structures (walls) such that they span between the walls. The ends of the bottom chords are then anchored to the support walls by screws, nails, or other appropriate anchors. A plurality of trusses is arranged in a side-to side configuration along the tops of the support walls. Often, a truss has a greater height dimension than a width direction. Thus, prior to attaching the sheathing materials, a truss that is supported only at its bottom by its attachment to supporting walls can be prone to topple over on its side. Such toppling over of even one truss can result in all of the trusses falling over similar to a row of dominos which can cause injury to construction personnel and damage the trusses and other building components.

A variety of clips and attachment devices have been developed for attaching trusses to top-plates of structure walls. For example, U.S. Pat. No. 4,932,173. to Commins, U.S. Pat. No. 4,986,052 to Nelson, and U.S. Pat. No. 5,335,469 disclose such devices. Those devices are typically difficult to manufacture and install. Many of such devices are only suited for use in connection with wood top plates and are ill-suited for use in connection with metal trusses and metal top plates. Some of such devices also require the contractor to measure and locate each one so that the trusses are attached to the top plate in a desired spacing arrangement.

Thus, there is a need for a support header for attaching a truss to the top plate of a wall or other structure that is relatively easy to manufacture and install.

Yet another need exists for a support header that may be effectively used with trusses and wall structures that are made from wood or metal or a combination of wood and metal.

Still another need exists for a support header that can be used to support and attach a variety of different structural components regardless of the type of material from which they are constructed to a variety of different wall structures and the like.

Another need exists for a support header that has a plurality of integrally formed tabs that are spaced at predetermined intervals such that trusses may be quickly attached thereto at desired spacing arrangements without separately measuring the distance between each truss during installation.

Still another need exists for a support header or top plate for supporting trusses that is constructed to distribute loads to adjacent studs when a truss does not align with a stud.

SUMMARY OF THE INVENTION

In accordance with one form of the present invention, there is provided an apparatus for supporting a building component on a structure. The apparatus includes a header that has a planar top portion, a first leg protruding from the planar top portion, and, a second leg protruding from the planar top portion. The second leg is spaced from the first leg. The apparatus further includes at least one building component connection tab that comprises a portion of the planar top portion. Each connection tab protrudes from the top portion opposite from the first and second legs to form an opening through the top portion. The apparatus is placed over the top plate or similar portion of a structure and is attached thereto with appropriate fasteners. Building components such as roof trusses, floor trusses, etc. are then fastened to corresponding attachment tabs by appropriate fasteners.

It is a feature of the present invention to provide a support header/load transfer device for building components such as trusses and the like that is easy to manufacture and install.

It is another feature of the present invention to provide a support header that may be effectively used with building components and structures that are made from wood or metal or a combination of wood and metal.

Yet another feature of the present invention is to provide a support header with the above-mentioned characteristics that can be used to support and attach a variety of different structural components regardless of the type of material from which they are constructed to a variety of different wall structures and the like.

Still another feature of the present invention is to provide a support header/load transfer device that has a plurality of integrally formed tabs that are spaced at predetermined intervals such that trusses may be quickly attached thereto at desired spacing arrangements without separately measuring the distance between each truss during installation.

Yet another feature of the present invention is to provide a top plate for supporting trusses and distributing loads when one or more trusses do not align with the studs in the walls upon which they are supported.

Accordingly, the present invention provides solutions to the shortcomings of prior truss spacer devices and braces. The subject invention is easy to manufacture and install. The subject invention may be used to affix a plurality of trusses to a portion of a structure. Those of ordinary skill in the art will readily appreciate, however, that these and other details, features and advantages will become further apparent as the following detailed description of the embodiments proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
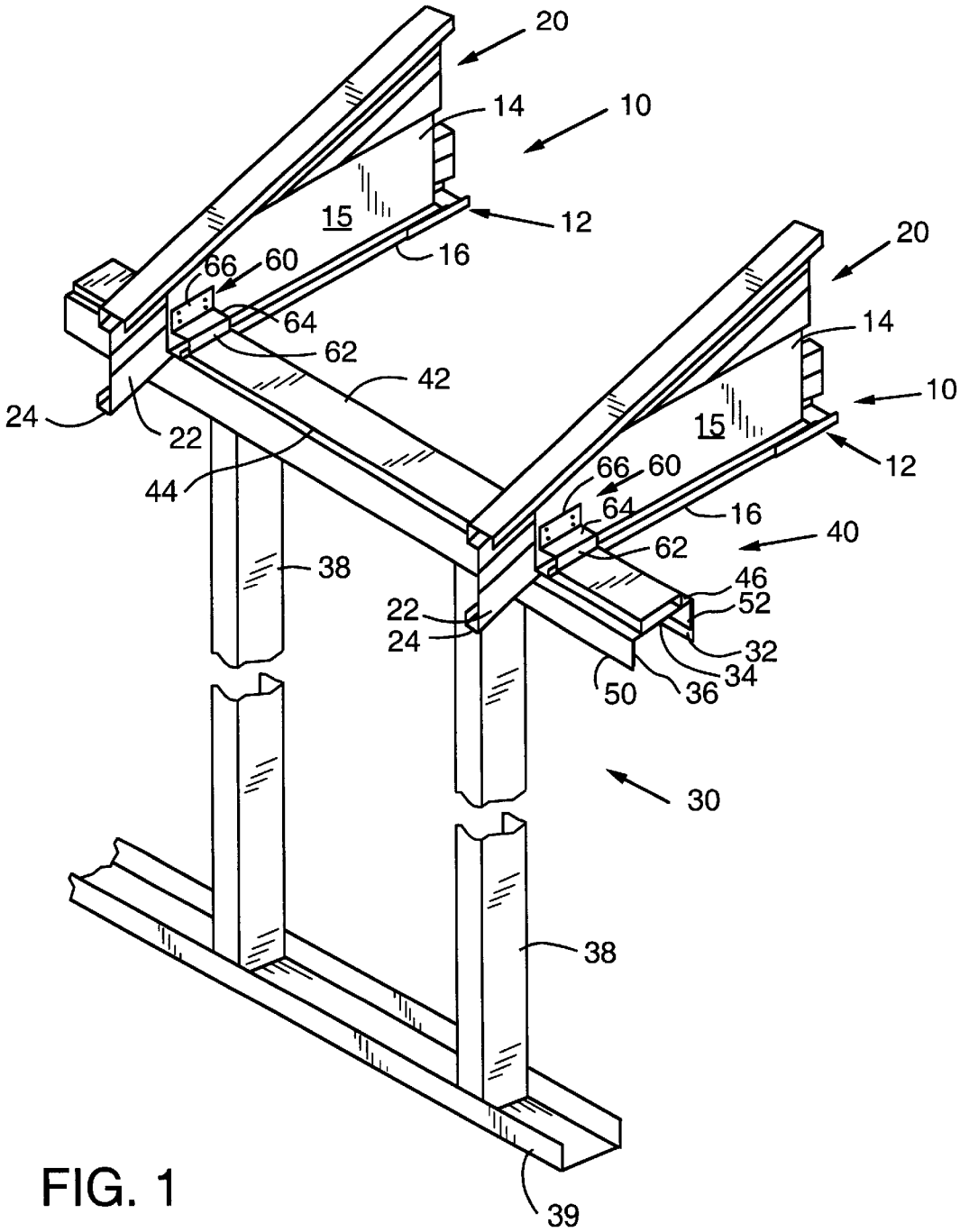
FIG. 1 is a perspective view of a support header of the present invention employed to affix metal roof trusses to a wall structure also fabricated from metal.
Figure 2:
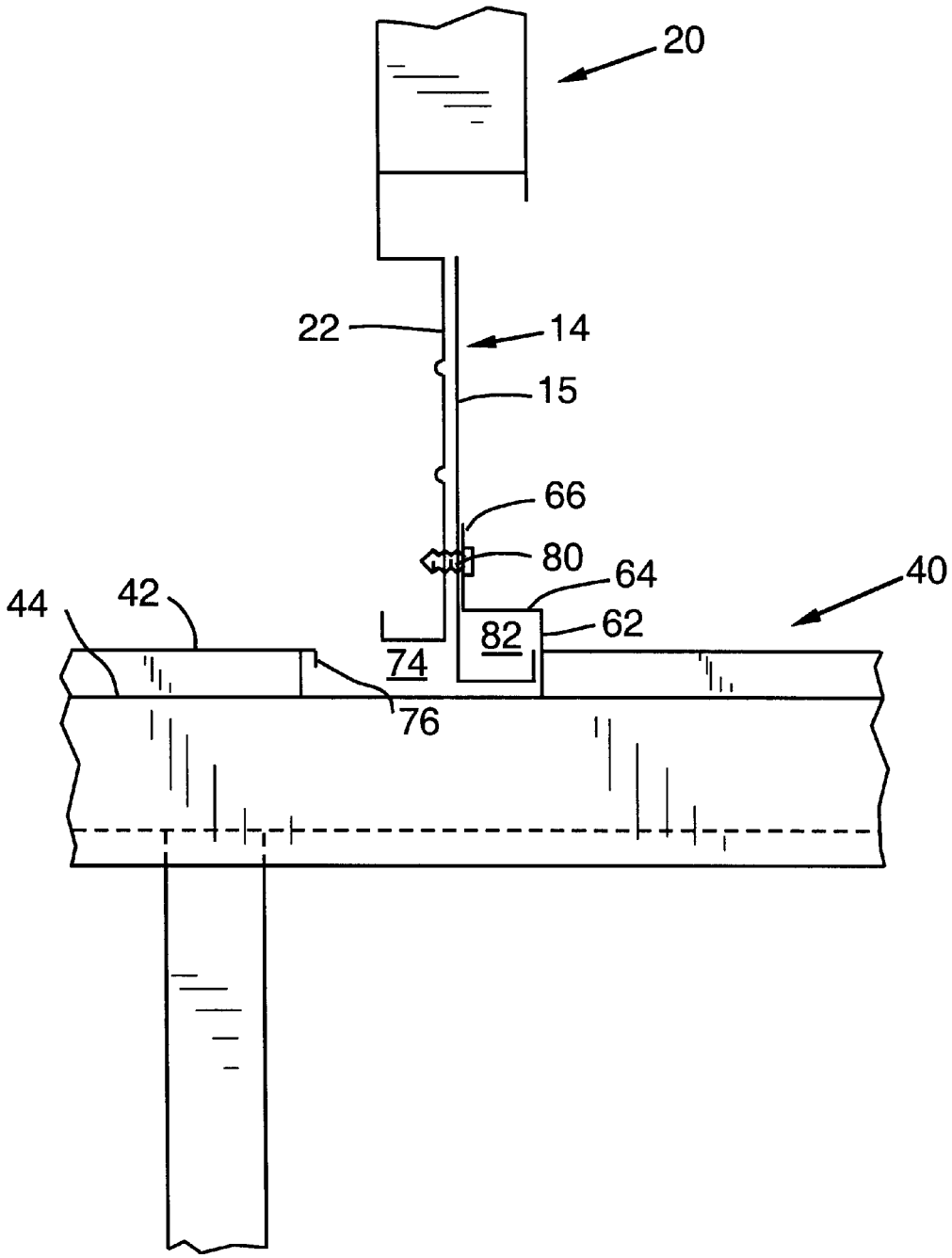
FIG. 2 is a partial front elevational view showing a portion of a support header of the present invention attaching a portion of a metal roof truss to a portion of a wall structure.

Referring now to the drawings for the purposes of illustrating the present embodiments of the invention only and not for the purposes of limiting the same, there is shown an apparatus or device 40 for supporting a building component 10 on a structure 30. More specifically and with reference to FIG. 1, there is shown a segment of a support header 40 received on a portion of a wall structure 30 and supporting a pair of trusses 10 thereon. The trusses 10 depicted in FIGS. 1 and 2 are fabricated from metal and have a lower chord 12 and a pair of upper chords 20 that are attached at one of their respective ends to the lower chord at a desired pitch by an attachment plate 14 or "J stiffener". The other ends of the upper chords 20 are attached together to form the peak (not shown). The attachment plate 14 has a "lower" vertically extending web 15 and a lower chord leg 16 protruding therefrom in a first direction. The end of the lower chord leg 16 may be bent at a ninety degree angle to provide the lower chord leg 16 with additional strength. The upper chord 20 has a vertically extending upper web portion 22 that is oriented adjacent to the vertically extending web 15 of the attachment plate 14 and is attached thereto. In addition, an upper chord leg 24 protrudes from the upper chord web 22 in a second direction that is opposite from the first direction as shown in FIGS. 1 and 2. The design and construction of such metal roof trusses is well-known in the art and will not be discussed in detail herein. As the present Detailed Description proceeds, however, the reader will appreciate that the support header of the present invention may be used in connection with a myriad of different roof truss configurations. It will be further appreciated that the present invention may be used to affix floor trusses and a variety of other components to structures at predetermined intervals therealong without departing from the sprit and scope of the present invention. Accordingly, the scope of protection afforded to the present invention should not be limited to use for attaching roof trusses to wall structures.

Figure 3:
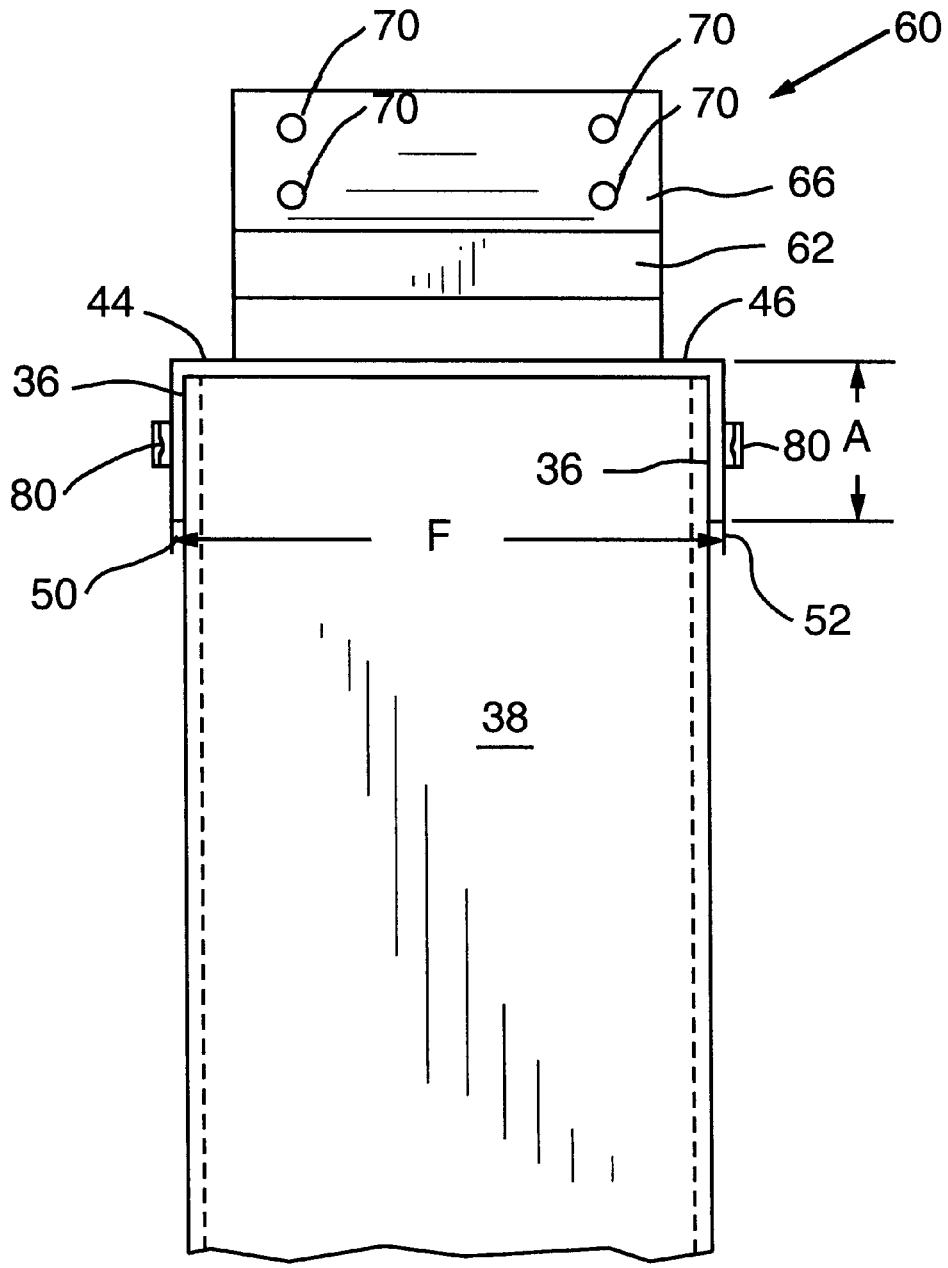
FIG. 3 is an end elevational view of the support header and truss of FIG. 2.

The wall structure 30 illustrated in FIGS. 1–3 includes a C-shaped top plate 32 that is fabricated from appropriately sized metal. The top plate 32 has a web portion 34 and two top plate legs 36 protruding from the web portion 34 a first distance represented as distance "A" in FIG. 3. For example, distance "A" may be 1¼ inches. Received between the top plate legs 36 are studs 38. Studs 38 are also attached to a bottom plate 39 and may be fabricated from metal or they may comprise wood or other suitable materials and are attached to the top plate 32 by appropriate fasteners (i.e., screws, rivets, nails, welds, etc.) at predetermined intervals.

FIGS. 4–7 illustrate an embodiment of the support header 40 of the present invention. As can be seen in those Figures, the support header 40 includes a first planar portion 42, a second planar portion 44 and a third planar portion 46. The second planar portion 44 and the third planar portion 46 may be substantially co-planar and substantially parallel with the first planar portion 42. With reference to this embodiment, the second planar portion 44 and the third planar portion 46 together may be broadly referred to herein as a "top portion" and the first planar portion may be broadly referred to herein as a "raised top portion". As used herein, "substantially co-planar" means co-planar to within a reasonable degree of error that might be introduced and considered acceptable in fabricating the apparatus as described and claimed herein. As used herein "substantially parallel" means parallel to within a reasonable degree of error that might be introduced and considered acceptable in fabricating the apparatus as described and claimed herein.

Figure 4:
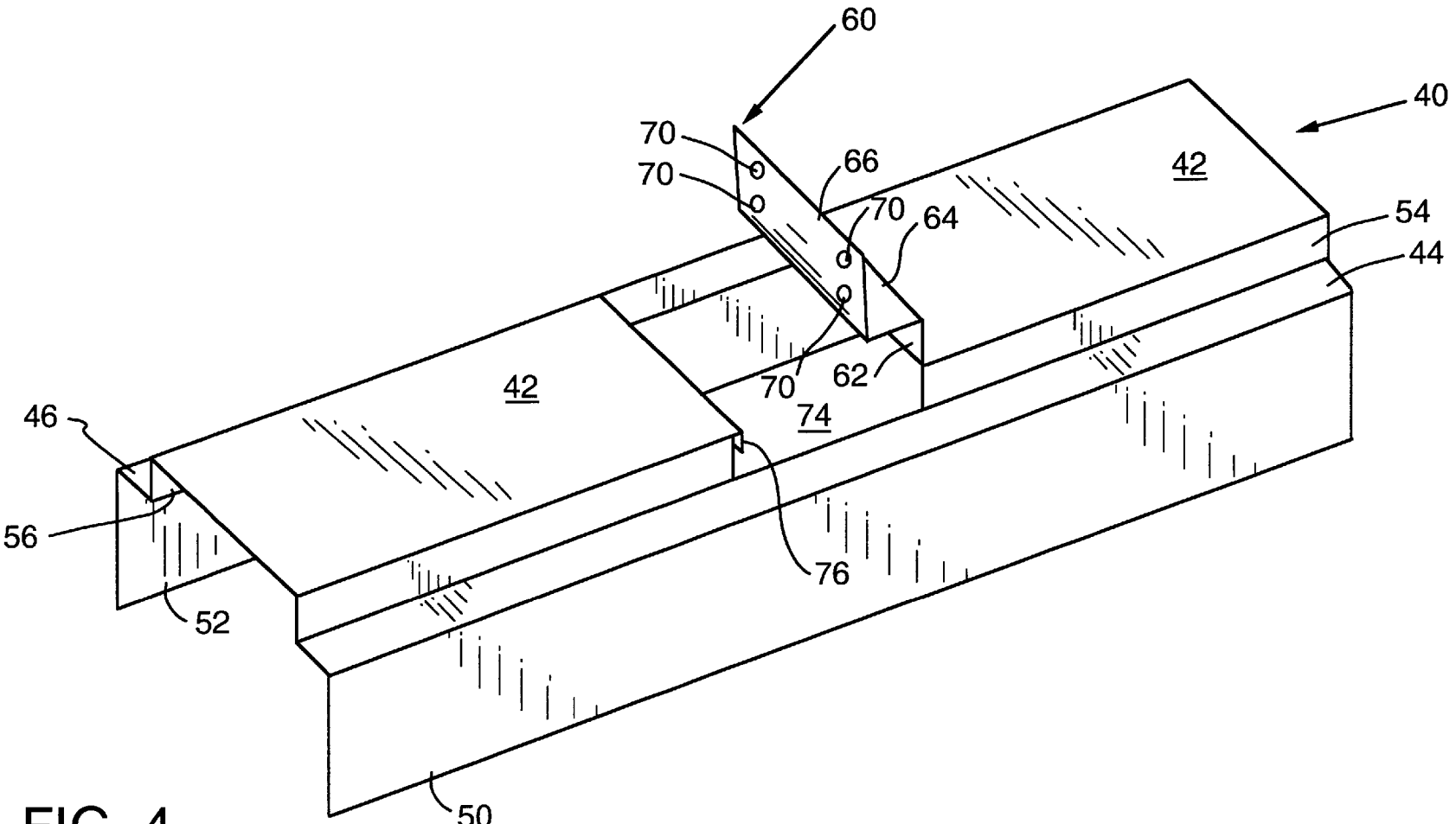
FIG. 4 is a perspective view of a segment of a support header of the present invention.
Figure 5:
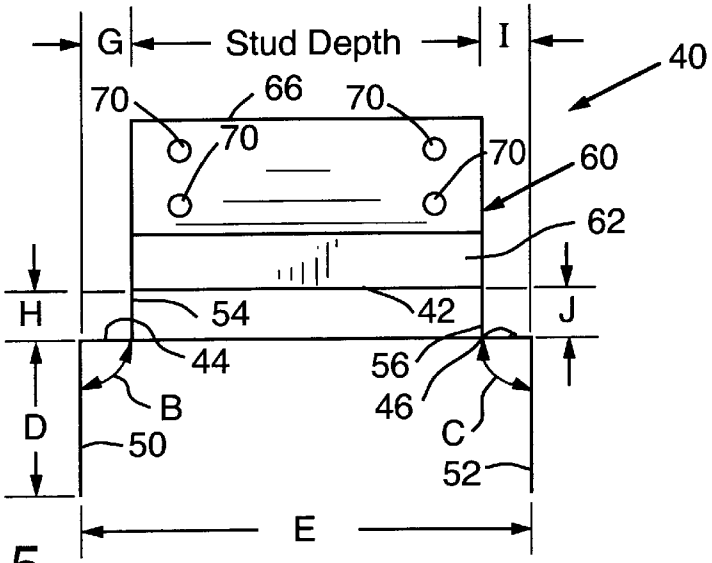
FIG. 5 is a left end elevational view of the support header depicted in FIG. 4.

As can be seen in FIGS. 3–5, a first leg 50 protrudes from the second planar portion 44 and a second leg 52 protrudes from the third planar portion 46. First leg 50 may be substantially perpendicular to the second planar portion 44 (i.e., angle "B" is approximately 90°) and second leg 52 may be substantially perpendicular to the third planar portion 46 (i.e., angle "C" is approximately 90°). See FIG. 5. As used herein, the term "substantially perpendicular" means perpendicular to within a reasonable degree of error that might be introduced and considered acceptable in fabricating the apparatus as described and claimed herein. First and second legs (50, 52) may thus be substantially parallel to each other and have a length "D". In one embodiment, length "D" is greater than length "A". For example, length "A" may be 1¼. inches and length "D" may be 2 inches–12 inches. See FIG. 3. In a preferred embodiment, depicted in FIG. 1, the length "D" is six inches. The skilled artisan will understand that when using such a double plate arrangement, the first plate (i.e., plate 32) serves to retain the studs internally. The longer leg plate (i.e., support header 40) provides structural load distribution between the studs. As will be discussed in further detail below, however, the subject support header may be effectively used to form wall structures without the use of a bottom plate 32. The reader will further appreciate that the distance between the first leg 50 and second leg 52 (distance "E") is equal to or slightly greater than the width "F" of the top plate 32 to enable the support header 40 to be snugly received thereon as shown in FIGS. 1 and 3. For example, distance "E" may be 3¾ inches and width "F" may be 3⅝ inches. The reader will also appreciate that, depending upon the gage of metal used to fabricate the support header, the distance "E" may be slightly (i.e., 1/16 inch) less than width "F" such that the support header may be installed on the top plate by applying a small amount of force to the support header thereby causing the top plate to be clamped between the legs 50 and 52. Thereafter, additional fasteners may be installed to retain the header in position as will be further discussed below. It will be further understood, however, that distance "E" will be dependent-upon the depth of the stud or header that it is to be installed over.

Also in this embodiment, a third leg 54 extends between the first planar portion 42 and the second planar portion 44 and a fourth leg 56 extends between the first planar portion 42 and the third planar portion 46 as shown in FIGS. 3 and 5. The third and fourth legs (54, 56) may be substantially parallel to each other and parallel to the first and second legs (50, 52). In one embodiment, the second planar portion 44 is approximately 0.5 inches wide (distance "G") and third leg is approximately 0.5 inches high (distance "H"). Similarly, the third planar portion 46 is approximately 0.5 inches wide (distance "I") and the fourth leg 56 is approximately 0.5 inches high (distance "J"). In the preferred embodiment depicted in FIG. 1, the planar portions 44 and 46 are approximately ¾ inch wide (distances "G" and "I").

To facilitate attachment of a truss 10 or other building component to the support header 40, an attachment tab assembly 60 is integrally formed from the first planar portion 42. In this embodiment, the attachment tab assembly 60 comprises a first tab portion 62 of the first planar portion 42 that is bent substantially perpendicular to the first planar portion 42 (i.e., angle "K". is approximately 90°). See FIG. 6. First tab 62 may protrude a distance "L" that is approximately 0.5 inches. As can also be seen in FIGS. 4 and 6, a horizontal portion is bent at substantially 90° relative to the first tab 62 (i.e., angle "M" is approximately 90°). In this embodiment, the horizontal portion 64 is approximately 1.0 inch long (distance "N" is approximately 1.0 inch). A second tab 66 protrudes from the end of the horizontal portion 64 at an angle that may be slightly greater than 90° (i.e., angle "O" may be 95°) and it may have a length of approximately 1.0 inch (i.e., distance "P" may be approximately 1.0 inch).

To facilitate easy attachment of the attachment tab assembly 60 to the truss 10 or other building component, at least one, and preferably a plurality of, fastener holes 70 may be provided through the second tab 66 as shown in FIG. 4.

Figure 6:
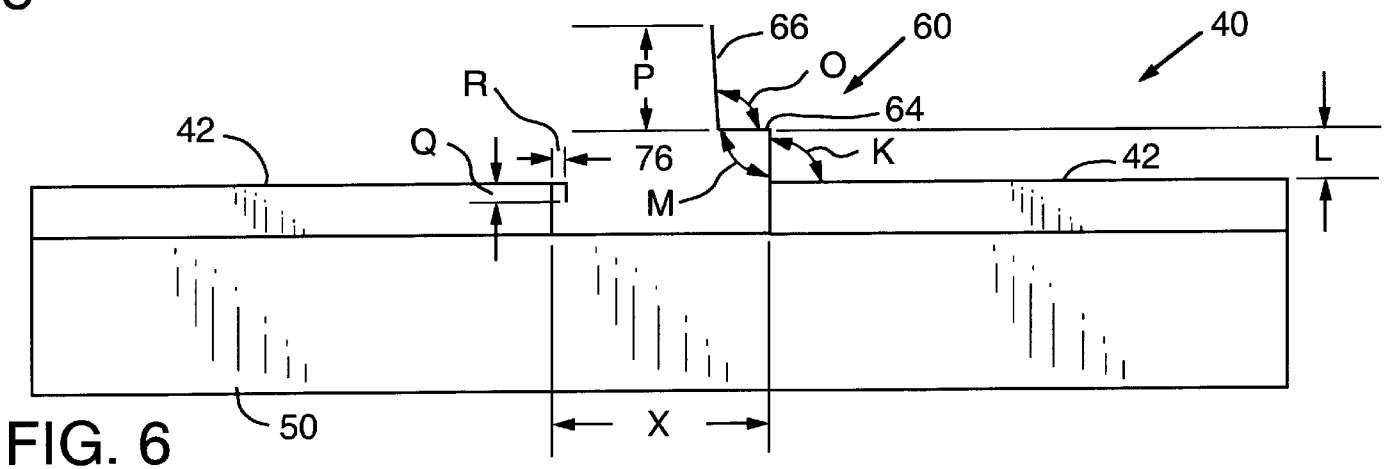
FIG. 6 is a front elevational view of the support header segment depicted in FIGS. 4 and 5.
Figure 7:
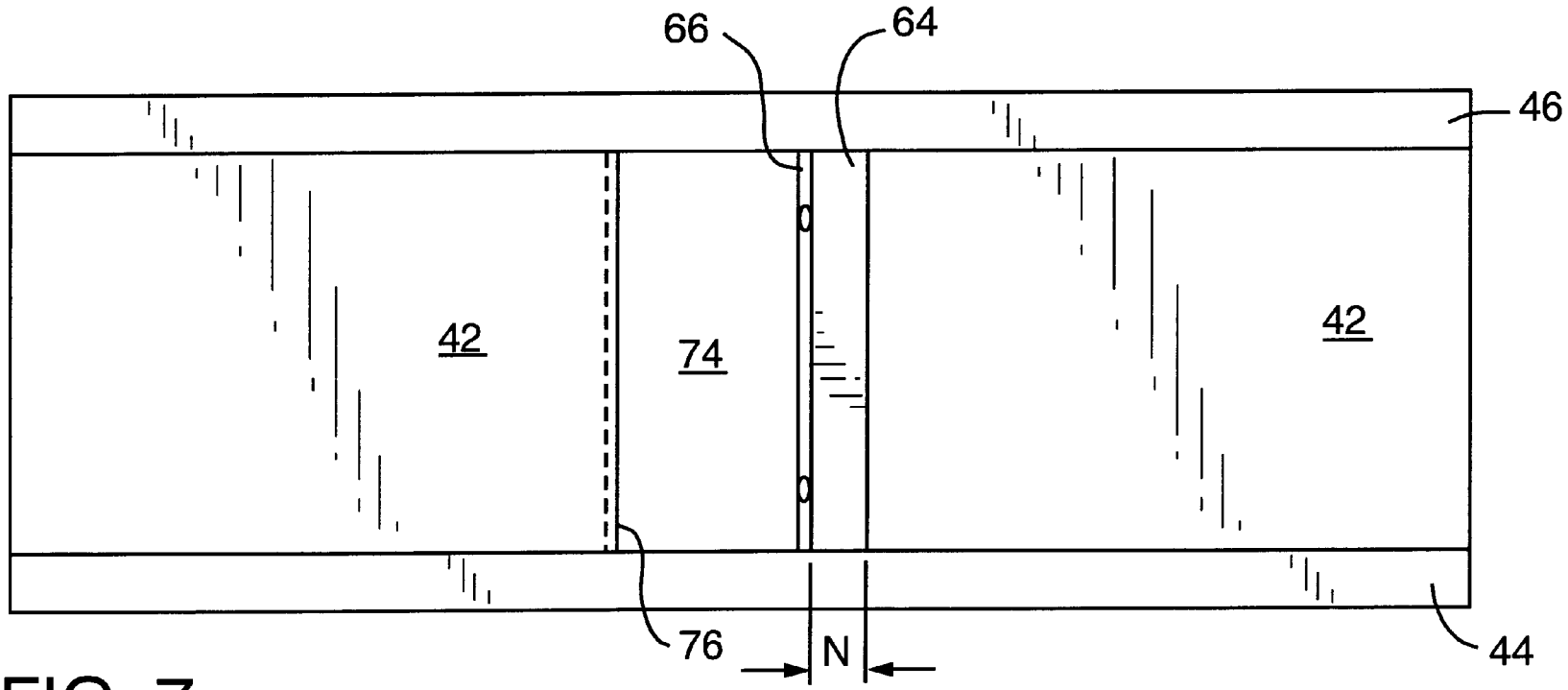
FIG. 7 is a top view of the support header segment depicted in FIGS. 4–6.

The skilled artisan will appreciate that the attachment tab assembly 60 as shown in FIGS. 4–7 is integrally formed from the first planar portion 42. In this embodiment, the support header 40 is fabricated from, for example, cold rolled galvanized steel. However, other appropriately sized metal may be employed. The support header 40 may be fabricated in any desired length with an appropriate number of attachment tab assemblies 60 formed therein. The support header 40 is formed from appropriately sized metal utilizing conventional roll forming and metal punching techniques and equipment. The attachment tab assembly 60 is then bent or configured into a desired configuration as described above utilizing conventional metal forming techniques and equipment. As can be seen in FIG. 7, formation of the attachment tab assembly 60 from the first planar portion 42 forms an opening 74 therethrough. In one embodiment, for example, opening may be approximately 2¾ inches long (distance "X" in FIG. 6). The reader will appreciate that the distance "X" may increase as the pitch gets steeper. To enable the attachment plate 14 of a truss to be supported on the second planar portion 44 and third planar portion 46 as will be discussed in further detail below, the portions of the third and fourth legs (54, 56) corresponding to the opening 74 are removed. To provide the support header 40 with further strength and rigidity, a tab 76, comprising a portion of a first planar portion 42, may be bent downward through the opening 74 as shown in FIGS. 4 and 6. Tab 76 serves to prevent an exposed edge, which could result in injury to installation personnel. In one embodiment for example, tab 76 may be approximately 0.25 inch long (distance "Q") and protrude into the opening 74 approximately 0.125 inch (distance "R"). The skilled artisan will appreciate that the various dimensions and angles described above are illustrative of one embodiment of the subject invention and may be altered to better conform the support header for attachment to other sizes and shapes of top plates, studs, etc. without departing from the spirit and scope of the present invention.

Use of this embodiment of the support header 40 can be understood from reference to FIGS. 1, 3, 8, 9, and 10. As can be seen in those Figures, the support header 40 is placed over the top plate 32 and the first and second legs (50, 52) of the support header 40 are affixed to the legs 36 of the top plate 32 by fasteners 80 which may comprise, for example, screws, rivets, welds, etc. See FIG. 3. Thereafter, each truss 10 is supported such that the attachment plate 14 of the truss 10 is received on the second planar portion 44 and third planar portion 46 of the support header 40 adjacent a corresponding attachment tab assembly 60. As can be seen in FIG. 2, the first tab 62 and horizontal portion 64 define a cavity 82 for receiving the lower leg 16 of the attachment plate 14 therein. After the truss 10 has been positioned in the above-mentioned manner, the second tab 66 is affixed to the web 15 of the attachment plate 14 and the upper web 22 of the upper chord by fasteners 80 (i.e., screws, rivets, etc.) that extend through the second tab 66 and through the webs (14, 22). Alternatively, the second tab 66 could be welded to the web 15 of the attachment plate 14.

Figure 8:
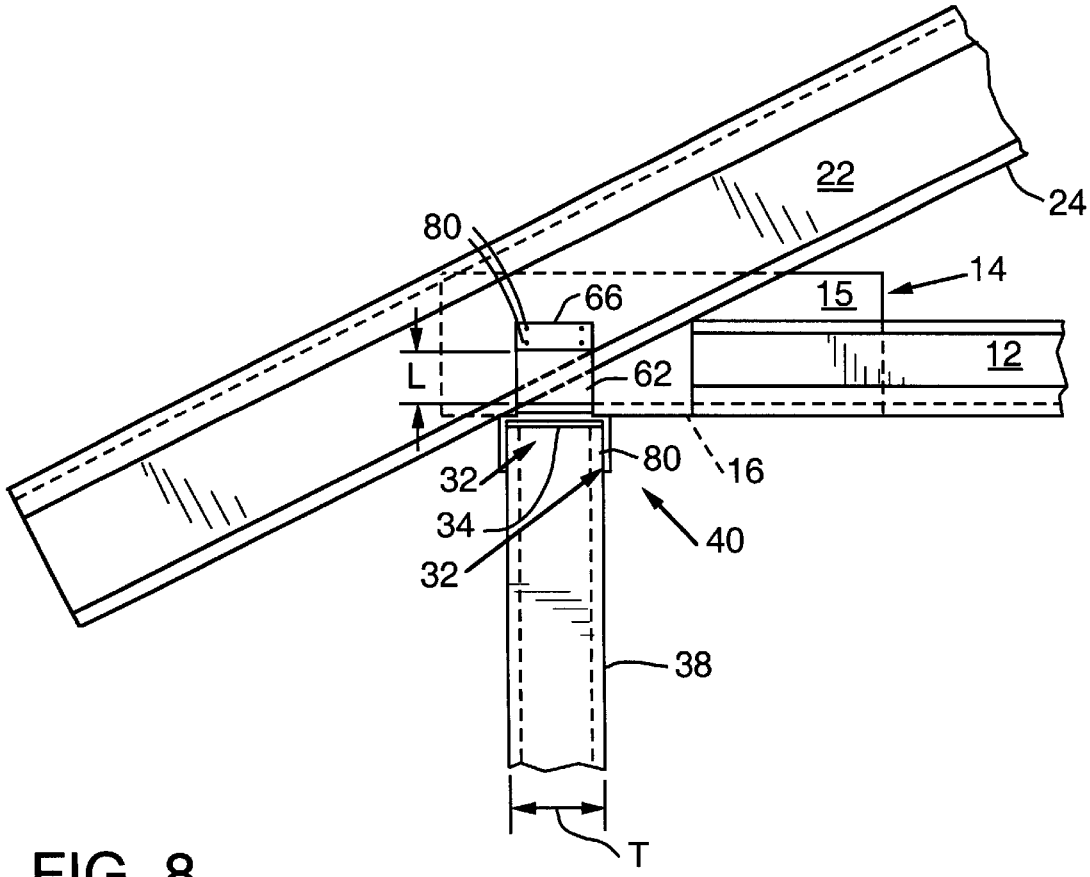
FIG. 8 is an end elevational view of a support header of the present invention used to attach a truss that has an 6:12 roof pitch to a top plate of a wall structure.
Figure 9:
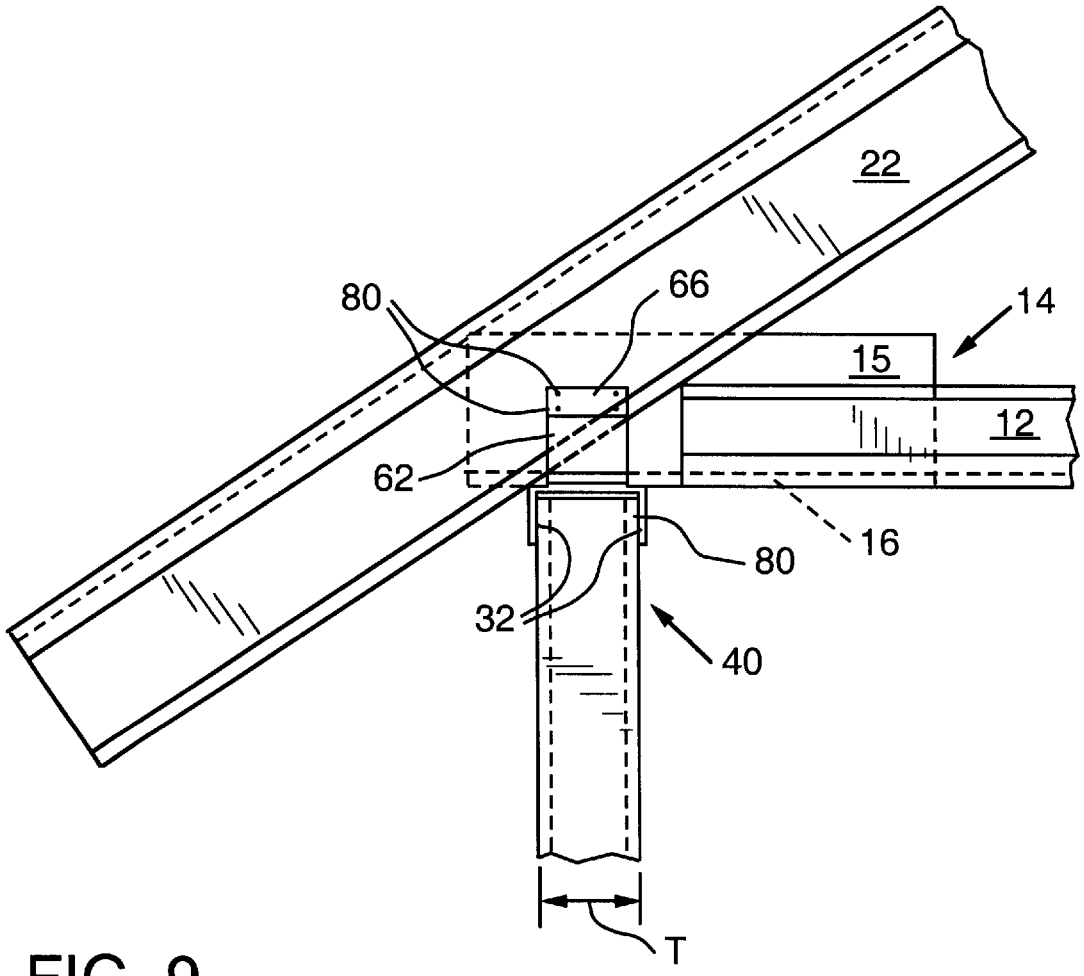
FIG. 9 is an end elevational view of another support header of the present invention used to attach a roof truss with an 8:12 roof pitch to a top plate of a wall structure.
Figure 10:
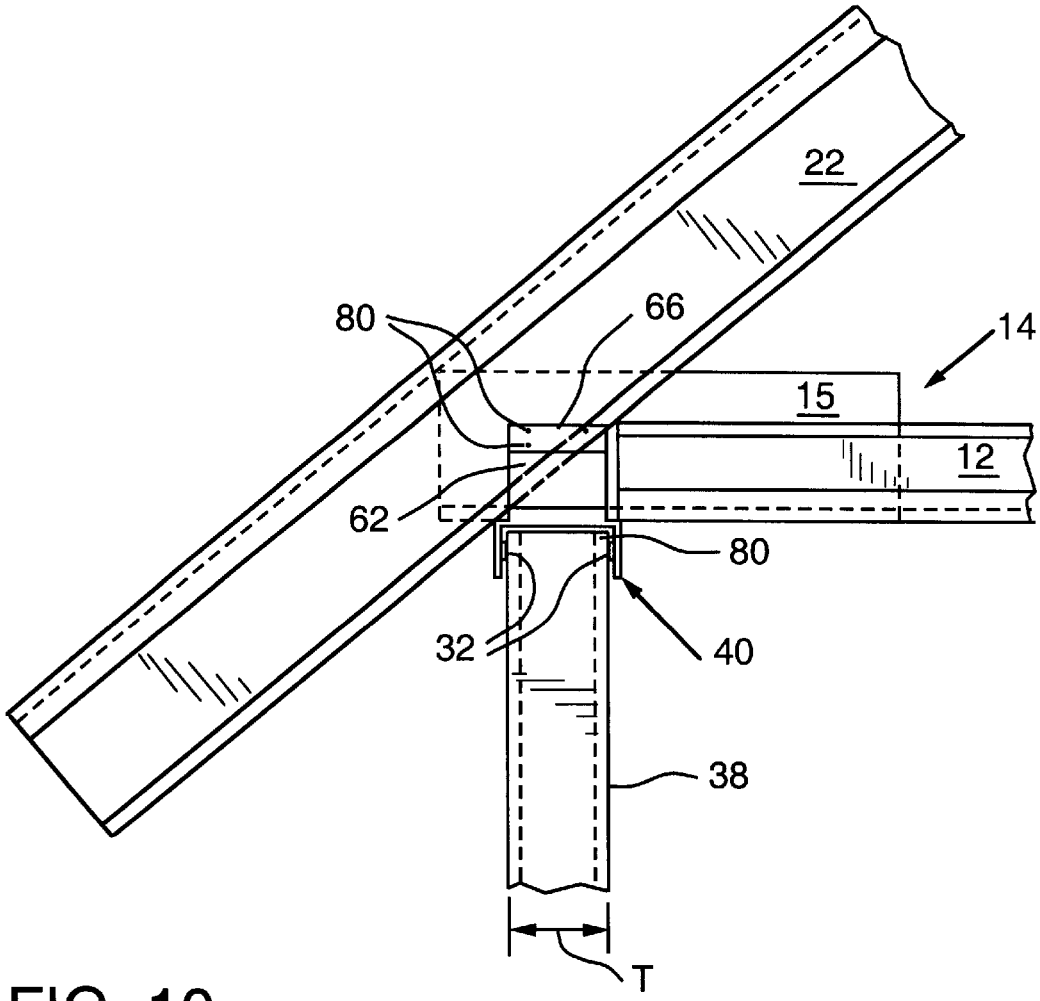
FIG. 10 is an end elevational view of another support header of the present invention used to affix a roof truss that has an 8:12 roof pitch to a top plate of a wall structure.
Figure 11:
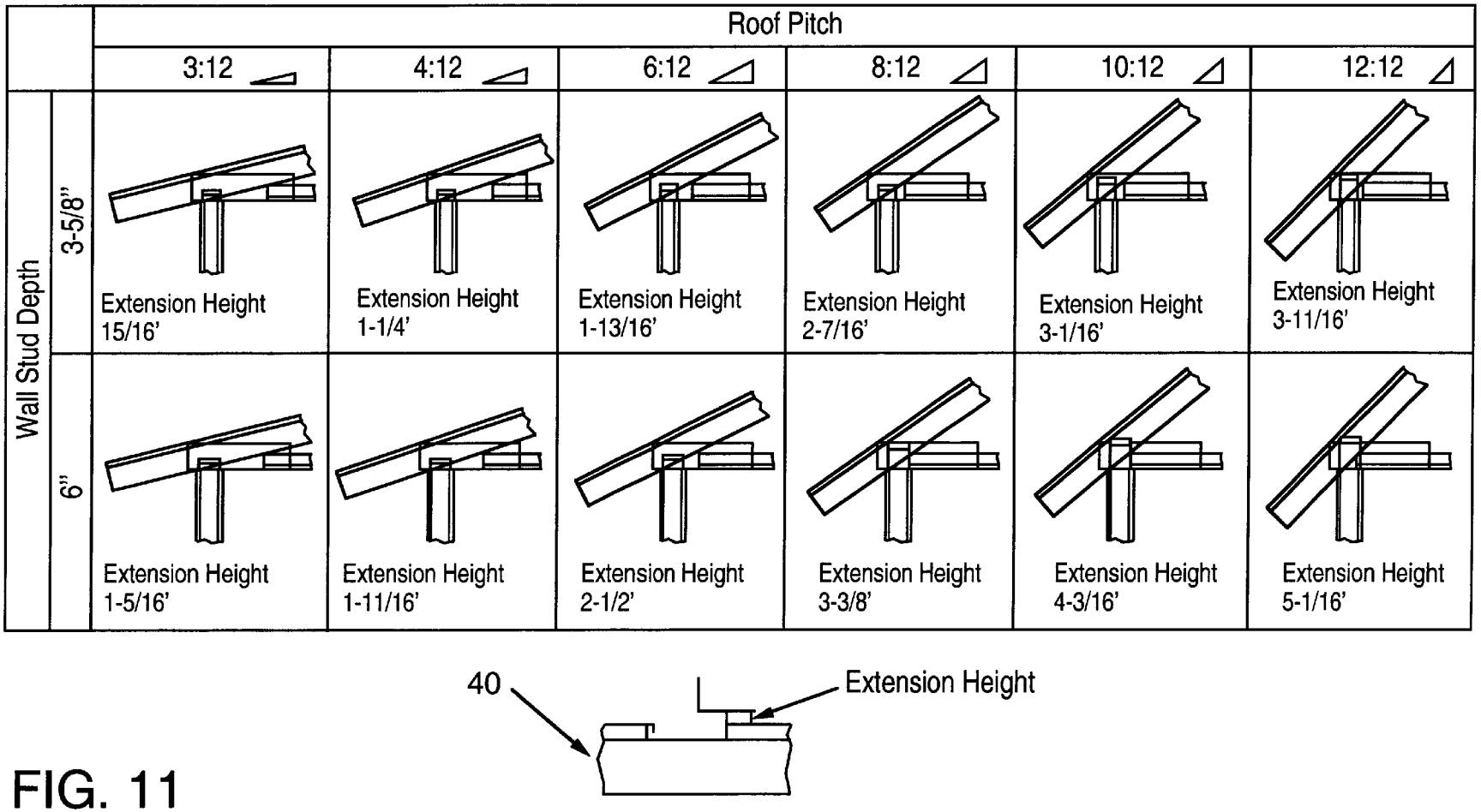
FIG. 11 is a chart illustrating various extension heights of support headers of the present invention for various stud depths and roof pitches.

FIG. 8 illustrates use of a support header 40 of the present invention for attaching a truss 10 that has a 6:12 roof pitch to a top plate 32 that has a width (distance "T") of approximately 3⅝ inches. Thus, to enable the second tab 66 to be fastened into the lower web 15 and, if desired, and the upper chord web 22, the height (distance "L") of the first tab 62 should be appropriately sized. FIG. 9 illustrates a support header 40 of the present invention used to attach a roof truss 10 with an 8:12 roof pitch to a top plate 32 that has a width (distance "T") of approximately 3⅝ inches. FIG. 10 illustrates a support header 40 of the present invention used to affix a roof truss that has an 8:12 roof pitch to a top plate that has a width of approximately 6 inches (distance "T"). FIG. 11 is a chart that depicts the extension height (distance "L" in FIG. 6) for a variety of different wall stud depths and roof pitches. The reader will, appreciate that the extension height increases as the roof pitch increases. It will be appreciated, however, that if the top plate is to be affixed to the bottom chord of the truss, the variances in the roof pitch may not affect the extension height.

Figure 12:
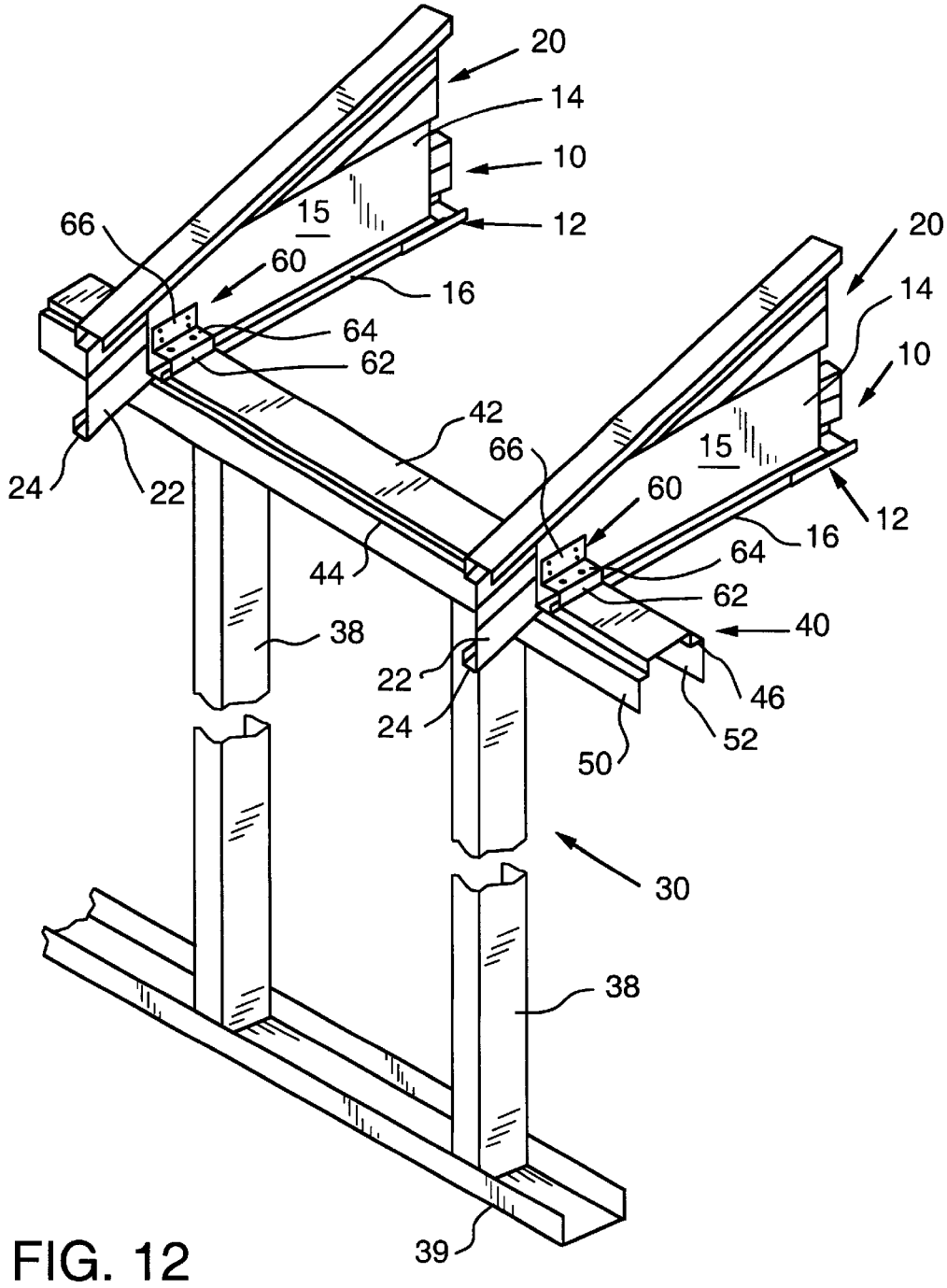
FIG. 12 is a perspective view of another support header of the present invention functioning as a top plate for a wall structure.

FIG. 12 depicts use of the support header 40 of the present invention as described above as a top plate for the wall structure. That is, in this embodiment, the wall structure 30 does not have a separate top plate 32. Instead, the support header 40 is the tope plate and the vertically extending studs 38 are affixed directly to the support header 40 by, for example, screws, welding, nails, etc.

Figure 13:
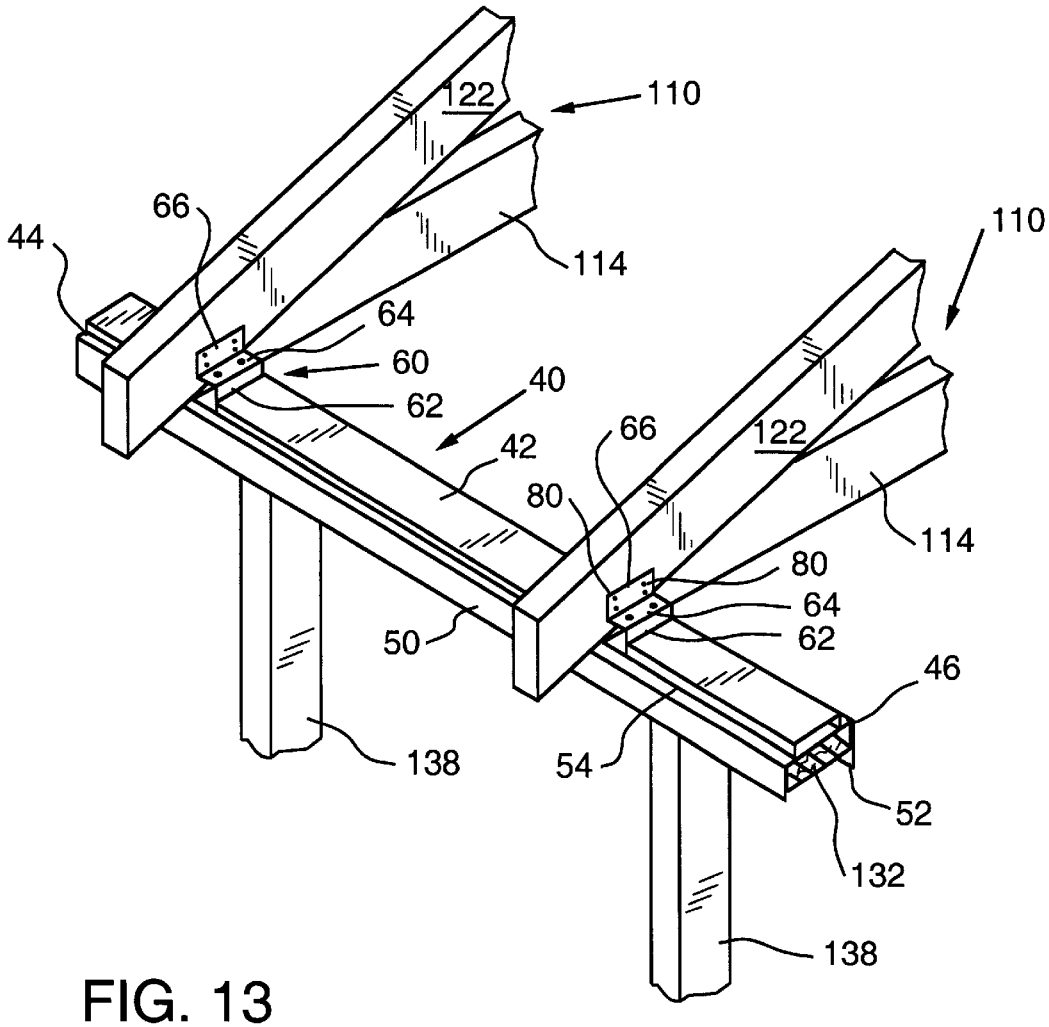
FIG. 13 is a perspective view of a support header of the present invention employed to affix wood roof trusses to a wall structure also fabricated from wood.
Figure 14:
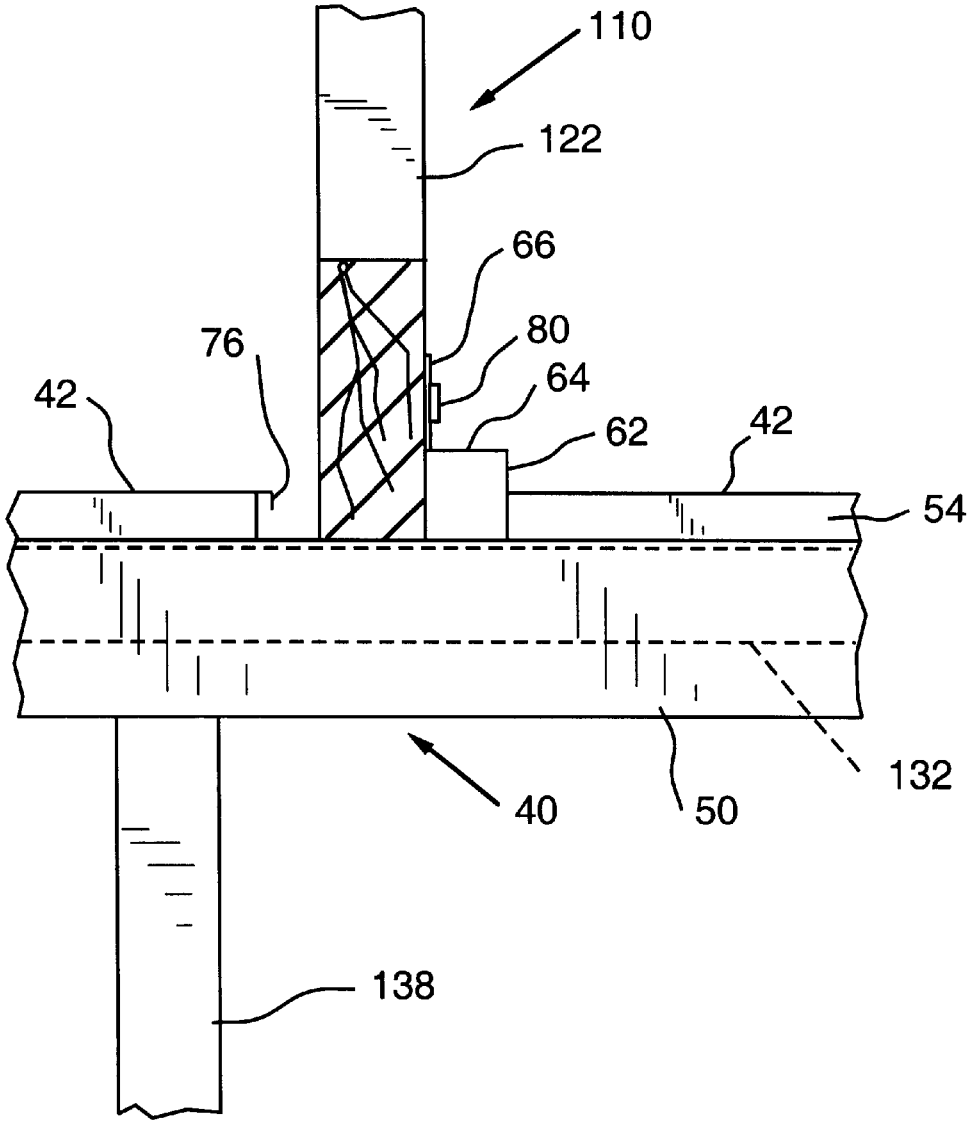
FIG. 14 is a partial front elevational view showing a portion of a support header of the present invention attaching a wood roof truss to a portion of a wall structure.
Figure 15:
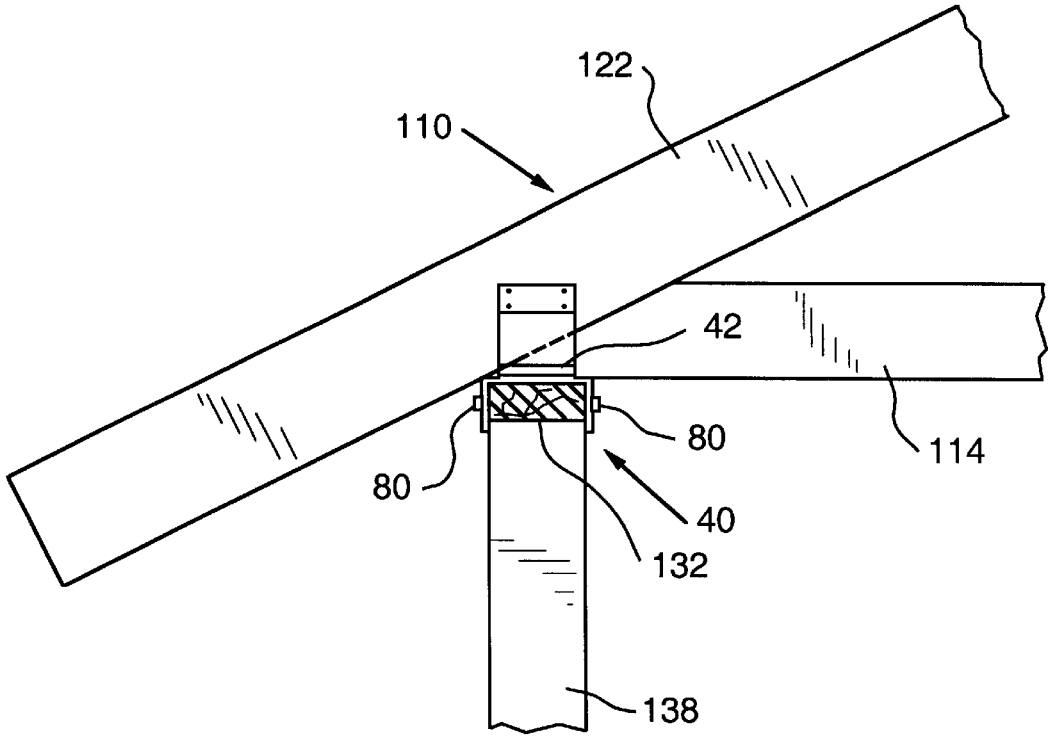
FIG. 15 is an end elevational view of a support header of the present invention affixing a wood roof truss to a wall structure fabricated from wood.

Those of ordinary skill in the art will also appreciate that the support header 40 of the present invention may also be successfully used in connection with wood trusses and stud arrangements. For example, as shown in FIGS. 13–15, the support header 40 of the present invention may be employed to affix wood trusses 110 to a wall having a wood stud top plate 132 that have a plurality of vertically extending wood studs 138 attached thereto. The support header 40 is sized to be received on the top plate 132 in any of the above-described manners and is attached thereto by fasteners such as screws or nails 80 that extend through the legs 50 and 52. Similarly the upper chord 122 (or lower chord 114 depending upon the truss design) is affixed to the second tab 66 by screws, nails, etc. 80.

Figure 16:
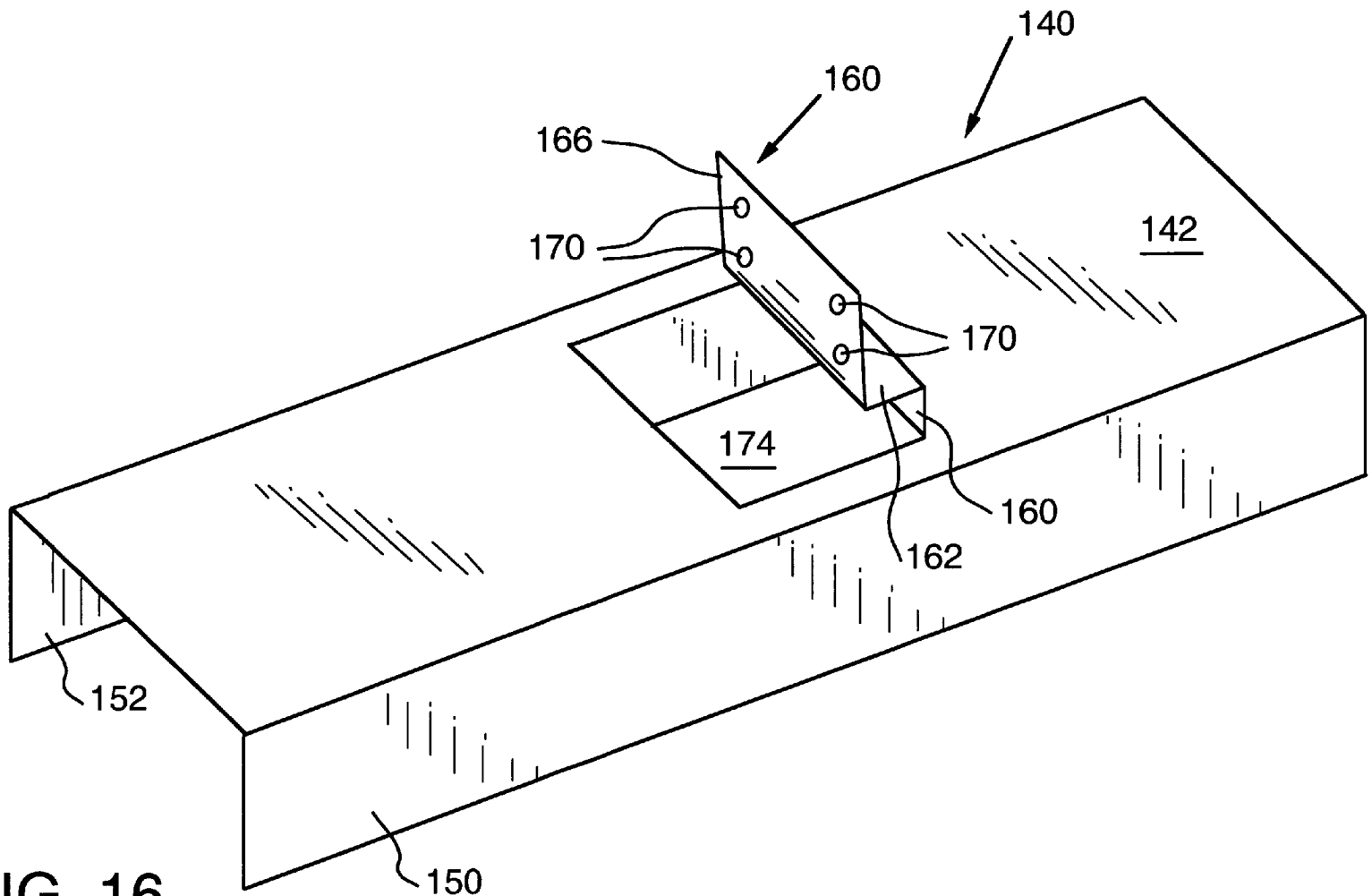
FIG. 16 is a perspective view of a segment of another support header of the present invention.
Figure 17:
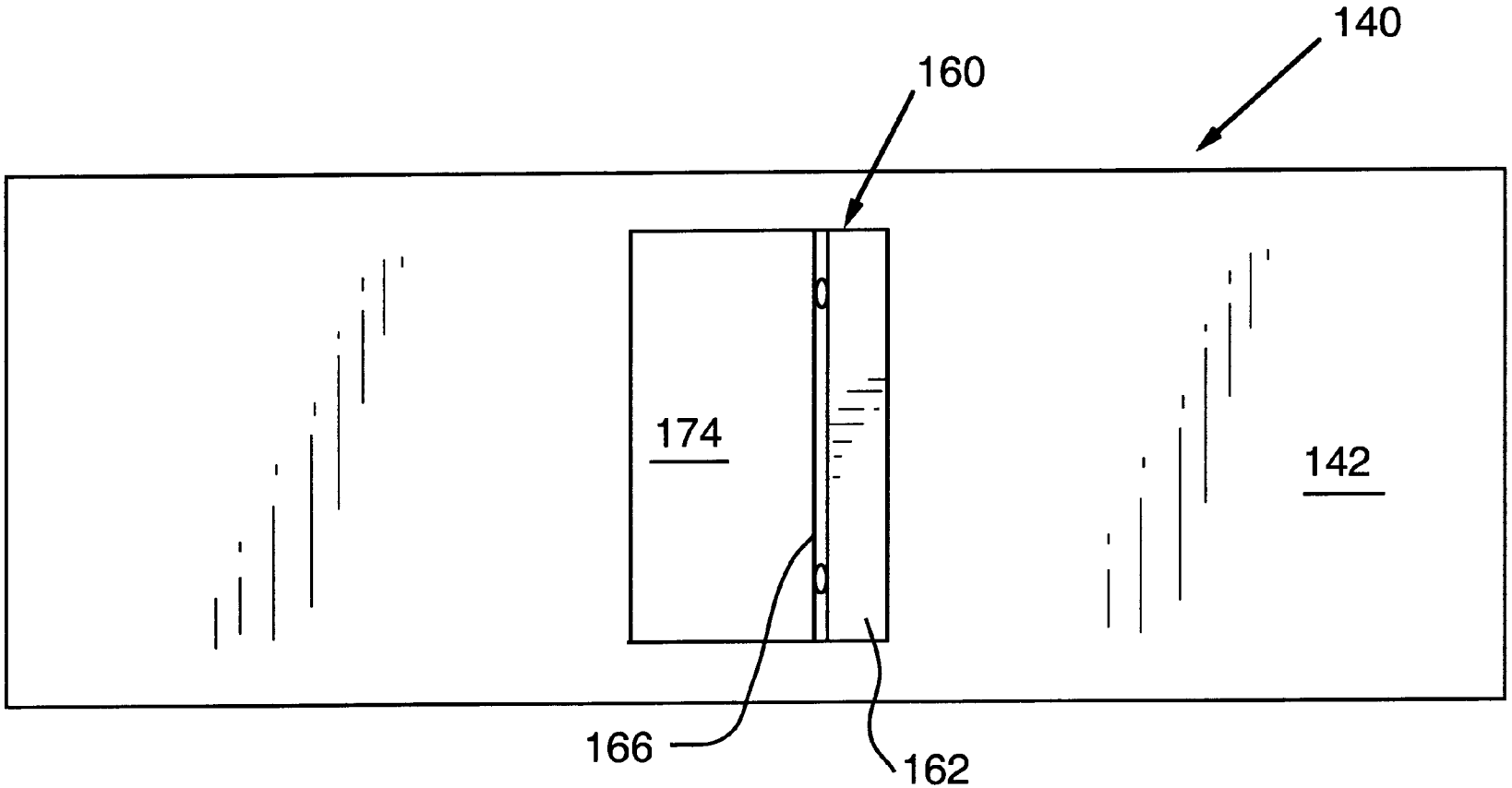
FIG. 17 is a top view of the support header segment of FIG. 16.

Another embodiment of the present invention is depicted in FIGS. 16 and 17. As can be seen in those Figures, the support header 140 has a first planar portion or "elongated planar top portion" 142 and a first leg 150 and a second leg 152 protruding therefrom. The first and second legs (150, 152) may each be substantially perpendicular to the first planar portion and be sized in the manner described above with respect to legs 50 and 52. The support header 140 also has an attachment tab assembly 160 protruding therefrom that is substantially identical to the attachment tab assembly 60 as described above and includes a first tab 160, a horizontal portion 162 and a second tab 166. The second tab 166 may have fastener holes 170 therethrough. The reader will appreciate that the attachment tab assembly is punched out of the first planar portion 142 and serves to define an opening 174 therethrough.

Figure 18:
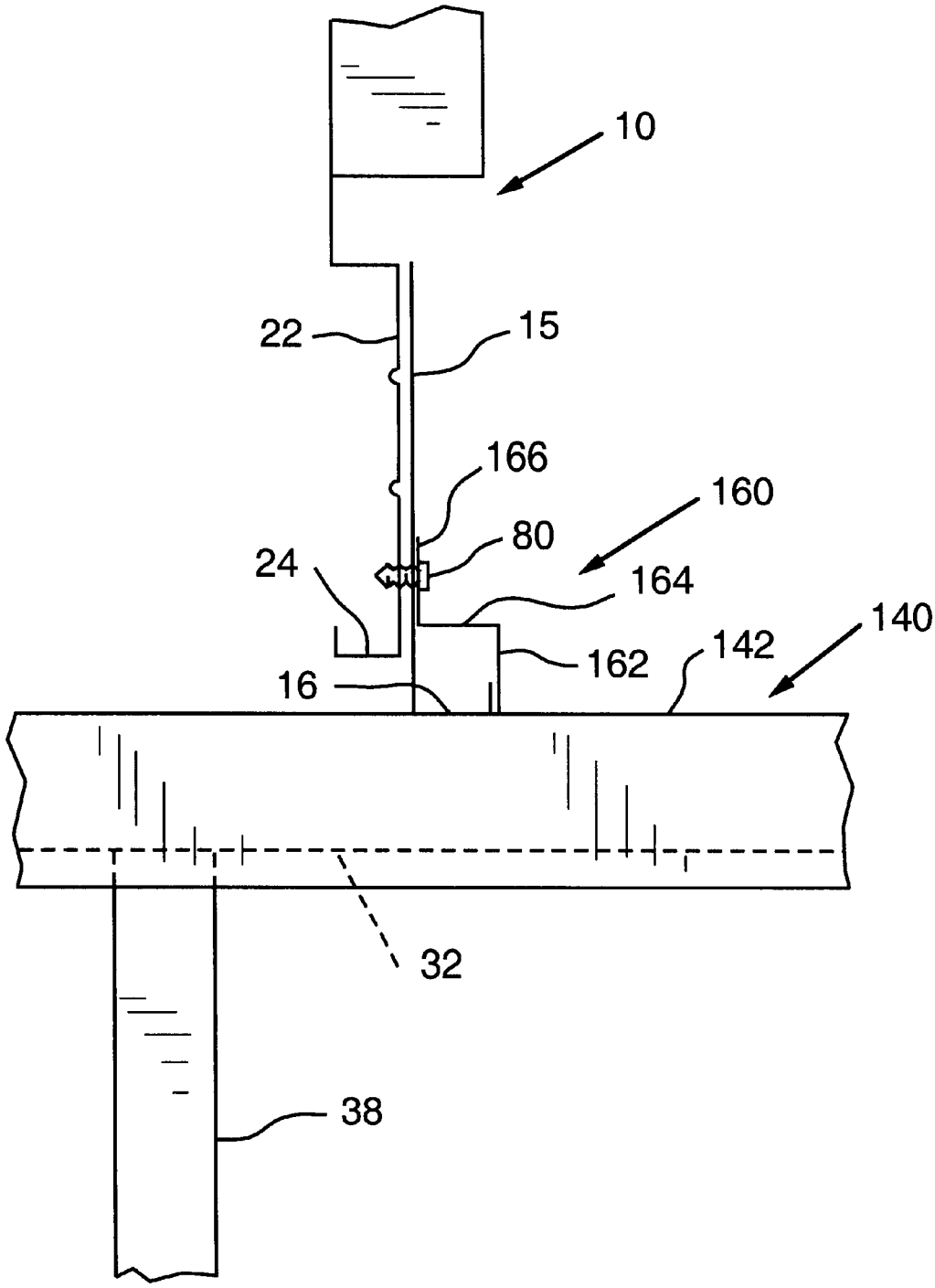
FIG. 18 is a partial front elevational view of the support header segment of FIGS. 16 and 17 attaching a metal roof truss to a wall structure fabricated from metal.
Figure 19:
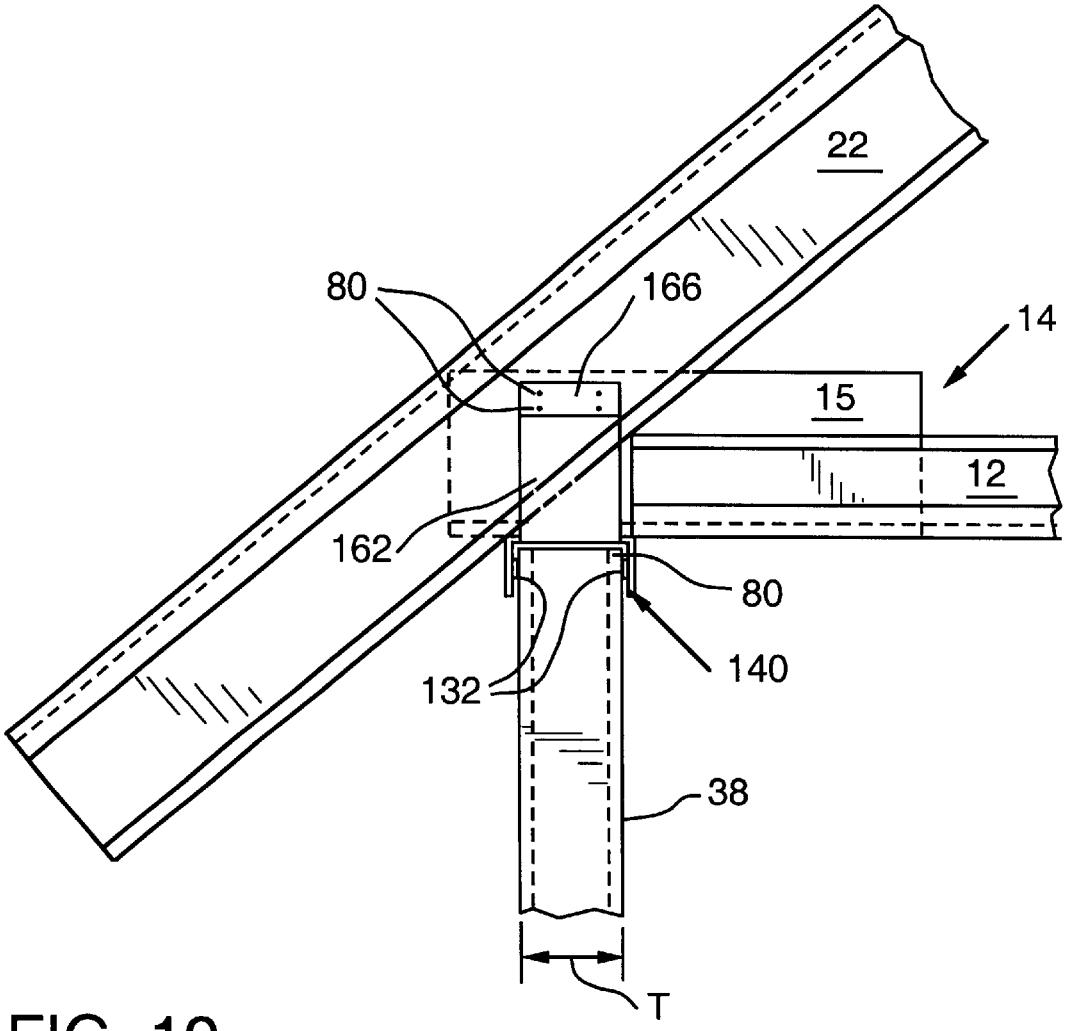
FIG. 19 is an end elevational view of the support header of FIGS. 16–18 used to affix a roof truss that has an 8:12 roof pitch to a top plate of a wall structure.
Figure 20:
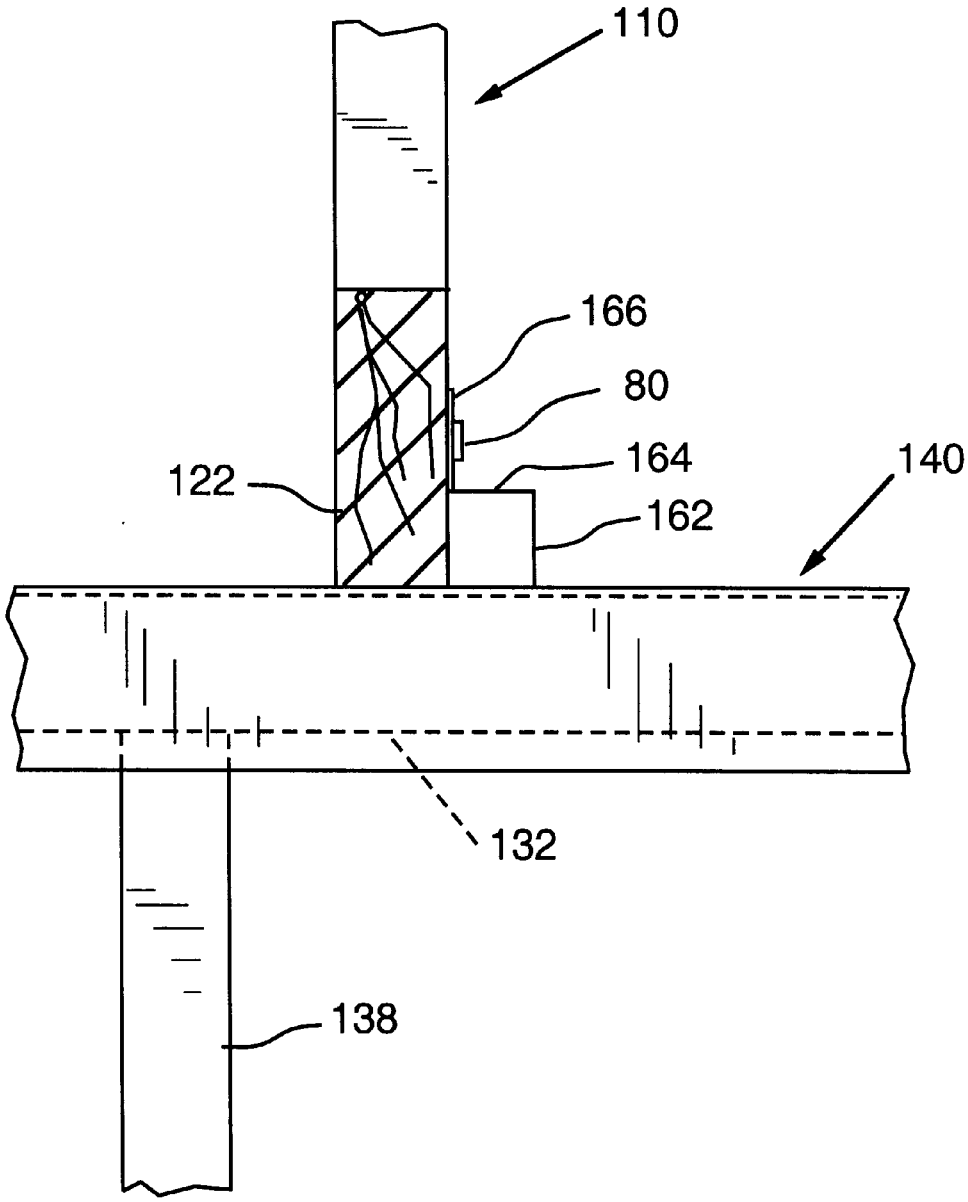
FIG. 20 is a partial front elevational view of the support header segment of FIGS. 15 and 16 attaching a wood roof truss to a wall structure fabricated from wood.
Figure 21:
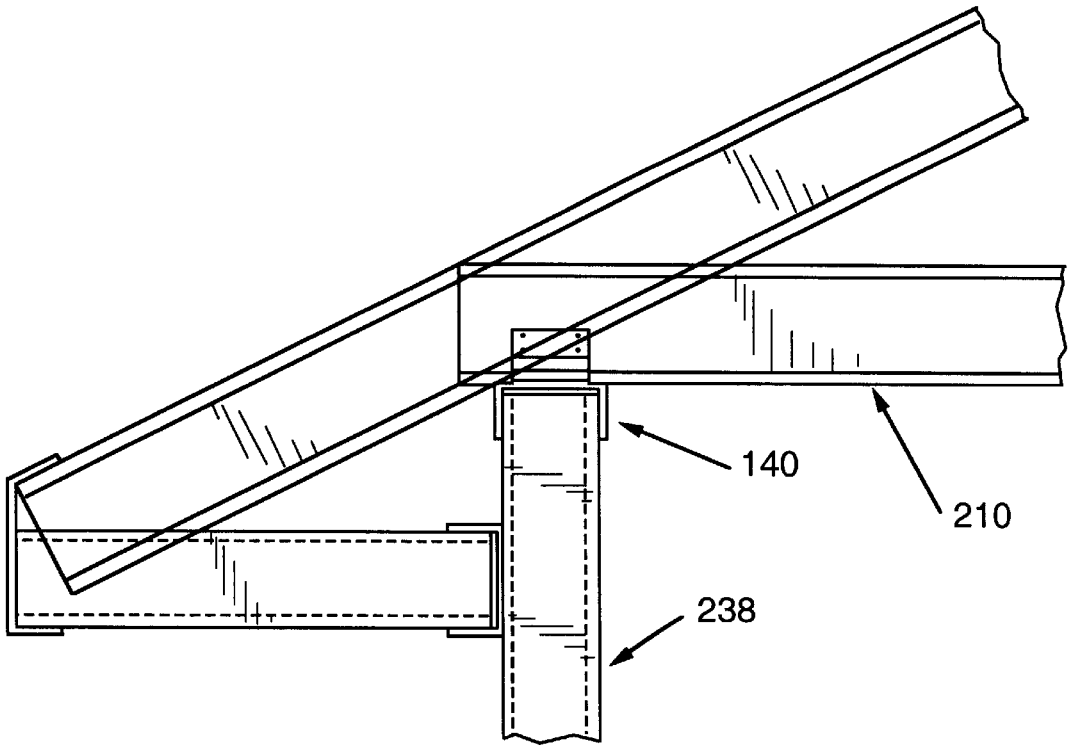
FIG. 21 is a perspective view of a support header of the present invention used to support a "C" truss on a wall structure.

As can be seen in FIGS. 18 and 19, the support header 140 may be used to affix a metal truss 10 to a metal top plate 32 of a wall structure including metal studs 38. Likewise, as shown in FIG. 20, the support header may be used to affix a wood truss 110 to a wood top plate 132 of a wall structure having wood studs 138. FIG. 21 illustrates the use of a support header 140 to affix a metal truss 210 known as a "C" truss to a top plate of a wall structure having metal studs 238.

Thus, from the foregoing discussion, it is apparent that the present invention provides many advantages over prior truss supporting devices and methods. In particular, the support headers of the present invention are easy to manufacture and install. The headers may be prefabricated to a desired length and with integral connection tab assemblies located at desired spacing intervals. Therefore, the contractor may quickly install the support header on the top plate and then begin the truss installation process without first measuring and laying out the truss spacing scheme. Accordingly, truss installation time is reduced. Furthermore, the support header of the present invention may be effectively used in connection with building components that are made from metal or wood. In either case, attachment of the truss to the wall structure is made easier and results in an improved method of attachment. For example, in the past, wood trusses were often "toe-nailed" into the top plate. Such toe-nailing often required a degree of skill to ensure that the nails were installed at a proper angle without splitting the lower chord of the truss or the top plate. The subject invention solves that problem. Use of the subject invention, when fabricated from appropriately sized material, also results in a stronger connection of the truss or other building component to a wall structure to resist wind uplift often experienced during tornadoes, hurricanes, etc. Also, the subject support header may be used in connection with the installation of floor trusses and other building components without departing from the spirit and scope of the present invention. While the foregoing description describes and depicts metal and wood trusses of specific shapes and sizes, those of ordinary skill in the art will appreciate that the support headers of the subject invention can be effectively used in connection with a variety of differently shaped trusses and other building components fabricated from metal, wood, plastic, etc.

In addition, depending upon the amount of loads applied to the structure, the skilled artisan will readily appreciate that it is conceivable that the support headers of the present invention could successfully function as the top plate of the wall structure. That is, the vertical studs would be directly attached to the support header, thereby eliminating the need for a separate top plate. In addition, the present invention can also function as a load transfer/distribution device for supporting trusses on wall structures wherein the trusses are not aligned with the studs comprising the wall structure. Those of ordinary skill in the art will appreciate that various changes in the details, materials and arrangement of parts which have been herein described and illustrated in order to explain the nature of the invention may be made by the skilled artisan within the principle and scope of the invention as expressed in the appended claims.

What is claimed is:

1. Apparatus for supporting a building component on a structure, said apparatus comprising:a header having a planar top portion, a first leg protruding from said planar top portion, and a second leg protruding from said planar top portion, said second leg spaced from said first leg; and a building component connection tab comprising a portion of said planar top portion and protruding therefrom opposite from said first and second legs to form an opening through said top portion, said connection tab having a first tab portion protruding from said top portion of said header, a horizontal portion protruding from said first tab portion and being substantially parallel to said top portion, and a second tab protruding from said horizontal portion at a predetermined angle.

2. The apparatus of claim 1 wherein said second leg is spaced from said first leg a distance that is greater than a width of a portion of the structure upon which said header is to be received.

3. The apparatus of claim 2 wherein said connection tab has a width that is less than said distance.

4. The apparatus of claim 1 wherein said predetermined angle is greater than 90.

5. The apparatus of claim 1 further comprising at least one attachment opening through said second tab.

6. The apparatus of claim 1 wherein said first tab portion has a first length and wherein said second tab has a second length that is greater than said first length of said first tab portion.

7. Apparatus for supporting a building component on a structure, said apparatus comprising:

a header having a first planar top portion, a first leg protruding from said first planar top portion, and a second leg protruding from said first planar top portion, said second leg spaced from said first leg;

a building component connection tab comprising a portion of said first planar top portion and protruding therefrom opposite from said first and second legs to form an opening through said first planar top portion, said first planar top portion further having second and third planar portions wherein said second and third planar portions are substantially coplanar with each other and wherein said first planar top portion is substantially parallel with said second and third planar portions and wherein said building component connection tab comprises a portion of said first planar top portion;

a third leg portion extending between said first planar top portion and said second planar portion; and a fourth leg portion extending between said first planar top portion and said third planar portion.

8. The apparatus of claim 7 wherein said first leg is longer than said third leg and wherein said second leg is longer than said fourth leg.

9. The apparatus of claim 7 wherein said third leg has a notch therein that corresponds to said opening through said first planar portion and wherein said fourth leg has a notch therein that corresponds with said opening through said first planar portion.

10. The apparatus of claim 7 wherein said opening is defined by said first tab on one end of said opening and a stiffener tab on another side of said opening.

11. The apparatus of claim 10 wherein said first tab extends in a first direction and wherein said stiffener tab extends in a second direction opposite from said first direction.

12. A header for supporting at least one truss having a lower cord and an upper chord on a structure, said header comprising:

a planar top portion, a first leg protruding from said planar top portion, and a second leg protruding from said planar top portion, said second leg spaced from said first leg to receive a portion of the structure therebetween; and an attachment tab integrally formed with said planar top portion and protruding therefrom opposite from said first and second legs and forming an opening through said top portion to permit a portion of the lower chord to be received in said opening and rest directly on a portion of the structure received between said first and second legs.

13. A header for supporting at least one truss on a structure, the truss having a lower chord with a lower vertically extending web and a lower chord leg protruding therefrom in a first direction and an upper chord having a vertically extending upper web adjacent the vertically extending lower chord web, the upper web having an upper chord leg protruding therefrom in a second direction opposite from the first direction, said header comprising:

a planar top portion, a first leg protruding from said planar top portion, and a second leg protruding from said planar top portion, said second leg, spaced from said first leg;

a first tab portion protruding from said top portion of said header;

a first horizontal portion protruding from said first tab portion, said first horizontal portion being substantially parallel to said top portion and defining a cavity for receiving a portion of the lower cord leg therein; and a second tab protruding from said first horizontal portion at a predetermined angle for attachment to the lower vertically extending web.

14. A header for supporting a truss on a top plate of a structure, said header comprising:

an elongated top portion;

a first leg protruding from said elongated top portion;

a second leg protruding from said elongated top portion and spaced from said first leg such that the top plate can be received therebetween;

a raised top portion protruding from said top portion opposite said first and second legs; and a connection tab comprising a portion of said raised top portion and protruding therefrom in an opposite direction from said first and second legs to form an opening therethrough.

15. A device for supporting at least one truss on a top plate of a structure, said device comprising: at least one metal truss having a lower chord with a vertically extending web and a lower chord leg protruding outward from said lower chord leg;

a C-shaped elongated header having a first planar portion and two leg portions; and a number of connection tabs corresponding to a number of trusses to be supported, each said connection tab being punched from said first planar portion and bent at a predetermined angle relative thereto, at least one said connection tab configured to define a cavity between a horizontal portion of said connection tab and said first planar portion of said header for receiving a portion of said lower chord leg of a corresponding truss therein.

16. The device of claim 15 wherein each said connection tab comprises:

a first tab protruding from said first planar portion of said header;

a horizontal portion protruding from said first tab, said horizontal portion being substantially parallel to said first planar portion; and a second tab protruding from said horizontal portion.

17. The device of claim 16 further comprising at least one attachment opening through said second tab.

18. The device of claim 15 wherein said vertical web portion and said lower chord leg are formed on a connection plate attached to a lower chord portion of said truss.

19. A wall structure comprising:

a bottom plate;

a top plate;

a plurality of wall studs extending between said top and bottom plates and attached thereto; and a C-shaped header member received over said top plate and having a web portion coextensive with at least a portion of said top plate, said web portion having at least two integral connection tabs protruding therefrom at predetermined spaced intervals from each other, at least one said integral connection tab having a first portion protruding from a top portion of said header member opposite said top plate, a horizontal portion protruding from said first portion, and a second portion protruding from said horizontal portion at an angle.

20. A wall structure comprising:

a bottom plate;

a plurality of wall studs, each said wall stud having a bottom portion affixed to said bottom plate and a top portion; and a header member having a web portion and two spaced leg portions, said header member received over said top portions of said wall studs and attached thereto, said web portion having at least two integral connection tabs protruding therefrom at predetermined spaced intervals from each other, at least one said integral connection tab having a first portion protruding from a top portion of said header member opposite from said two spaced leg portions, a horizontal portion protruding from said first portion, and a second portion protruding from said horizontal portion at an angle.

21. A structure, comprising:

an upstanding wall having a top plate that has a first web portion and two first legs protruding from said web portion a first distance; and a header member received over said top plate and having a primary web portion coextensive with at least a portion of said top plate, said primary web portion having an upper side and a lower side and two primary leg portions protruding from the lower side a second distance that is greater than said first distance and at least one integral connection tab protruding from said upper side of said primary web, at least one said integral connection tab having a first portion protruding from a top portion of said header member opposite from said two spaced leg portions, a horizontal portion protruding from said first portion, and a second portion protruding from said horizontal portion at an angle.

22. Apparatus for supporting a building component on a structure, said apparatus comprising:

a header having a planar top portion, a first leg protruding from said planar top portion, and a second leg protruding from said planar top portion, said second leg spaced from said first leg; and a building component connection tab comprising a portion of said planar top portion and protruding therefrom opposite from said first and second legs to form an opening through said top portion, said connection tab having a first tab portion protruding from said top portion of said header and adjacent said opening, a horizontal portion protruding from said first tab portion and being substantially parallel to said top portion, and a second tab protruding from said horizontal portion at a predetermined angle, said header further having a stiffener tab on a side of said opening opposite said first tab portion.

23. The apparatus of claim 22 wherein said first tab portion extends in a first direction and wherein said stiffener tab extends in a second direction opposite from said first direction.

24. A device for supporting at least one truss on a top plate of a structure, said device comprising:

a wall structure having a wooden top plate;

at least one truss having a wooden lower chord;

a C-shaped elongated header having a first planar portion and two leg portions; and a number of connection tabs corresponding to a number of trusses to be supported, at least one said connection tab comprising a portion of said planar top portion and protruding therefrom opposite from said two leg portions to form an opening through said top portion for receiving a lower chord of one of said trusses therethrough, said connection tab having a first tab portion protruding from said top portion of said header, a horizontal portion protruding from said first tab portion and being substantially parallel to said top portion, and a second tab protruding from said horizontal portion at an angle for attachment to a portion of one of said trusses.

25. A method for building a structure, comprising:

constructing at least two vertical walls wherein at least one of said vertical walls has a top plate;

constructing at least one truss sized to extend between said at least to vertical walls;

forming a header from metal, said header having a top portion and two leg portions protruding therefrom, the leg portions spaced from each other such that the top plate of a vertically extending wall may be received therebetween, said top portion having at least one tab integrally protruding therefrom corresponding in number to the plurality of trusses, each said tab having a first portion protruding from said top portion, a horizontal portion protruding from the top portion and a connection portion protruding from the horizontal portion;

installing the header on the top plate of a wall such that the top plate is received between the two leg portions of the header;

supporting a portion of a truss on the header adjacent the connection portion of one of the tabs; and coupling the portion of the truss adjacent to the connection portion to the connection portion.

26. A method for building a structure, comprising:

forming a header from metal, said header having a top portion and two leg portions protruding therefrom in spaced relation to each other, the top portion having at least one tab integrally protruding therefrom, each said tab having a first portion protruding from said top portion, a horizontal portion protruding from the top portion and a connection portion protruding from the horizontal portion;

inserting a plurality of studs between the two leg portions to form a wall structure and coupling the studs to the header;

supporting the wall structure in a vertical orientation;

placing a truss on the header adjacent one of the connection portions and coupling the.

* * * * *

UNITED STATES PATENT AND TRADEMARK OFFICE

CERTIFICATE OF CORRECTION

PATENT NO. : 6,430,881 B1 
DATED : August 13, 2002
INVENTOR(S) : Larry Randall Daudet, Edmund L. Ponko and Gregory S. Ralph It is certified that error appears in the above-identified patent and that said Letters Patent is hereby corrected as shown below:

Column 9,
Line 62, delete “a”.
Line 63, insert -- a -- before “header”.

Column 10,
Line 18, delete “90” and replace therewith -- 90º --.

Column 14,
Line 38, after “the” insert -- truss thereto --.

Signed and Sealed this

Eighteenth Day of February, 2003

JAMES E. ROGAN
*Director of the United States Patent and Trademark Office*